US007107216B2

(12) United States Patent
Hain

(10) Patent No.: US 7,107,216 B2
(45) Date of Patent: Sep. 12, 2006

(54) GRAPHEME-PHONEME CONVERSION OF A WORD WHICH IS NOT CONTAINED AS A WHOLE IN A PRONUNCIATION LEXICON

(75) Inventor: Horst-Udo Hain, Simplonstr (DE)

(73) Assignee: Siemens Aktiengesellschaft, Munich (DE)

( * ) Notice: Subject to any disclaimer, the term of this patent is extended or adjusted under 35 U.S.C. 154(b) by 733 days.

(21) Appl. No.: 09/942,735

(22) Filed: Aug. 31, 2001

(65) Prior Publication Data

US 2002/0046025 A1 Apr. 18, 2002

(30) Foreign Application Priority Data

Aug. 31, 2000 (DE) ..... 100 42 944

(51) Int. Cl.
*G10L 13/08* (2006.01)

(52) U.S. Cl. ..... 704/260

(58) Field of Classification Search ..... 704/258, 704/259, 260, 266, 269
See application file for complete search history.

(56) References Cited

U.S. PATENT DOCUMENTS

| | | | | |
|---|---|---|---|---|
| 5,651,095 | A * | 7/1997 | Ogden | 704/260 |
| 5,732,388 | A | 3/1998 | Hoege et al. | |
| 5,913,194 | A * | 6/1999 | Karaali et al. | 704/259 |
| 6,018,736 | A * | 1/2000 | Gilai et al. | 707/6 |
| 6,029,135 | A | 2/2000 | Krasle | |
| 6,076,060 | A * | 6/2000 | Lin et al. | 704/260 |
| 6,108,627 | A * | 8/2000 | Sabourin | 704/243 |
| 6,188,984 | B1 * | 2/2001 | Manwaring et al. | 704/260 |
| 6,208,968 | B1 * | 3/2001 | Vitale et al. | 704/260 |
| 6,411,932 | B1 * | 6/2002 | Molnar et al. | 704/260 |

FOREIGN PATENT DOCUMENTS

| | | |
|---|---|---|
| DE | 196 36 739 | 7/1997 |
| DE | 197 19 381 | 1/1998 |
| DE | 694 20 955 T2 | 7/2000 |

OTHER PUBLICATIONS

Kim et al., "Unlimited Vocabulary Grapheme to Phoneme Conversion for Korean TTS", Oct. 8, 1998, pp. 675-679, XP 002224173—Dept. of Computer Science & English.
H. Hain, Automation of the Training Procedures for Neural Networks Performing Multi-Lingual Grapheme-to-Phoneme Conversion, Proceedings Eurospeech 1999, vol. 5, 1999, pp. 2087-2090.
H. Hain, A Hybride Approach for Grapheme-to-Phoneme Conversion Based on a Combination of Partial String Matching and a Neural Network:, 2000, pp.~ 291-294.
Horst-Udo Hain; "Automation of the Training Procedures for Neural Networks Performing Multi-Lingual Grapheme to Phoneme Conversion", Eurospeech 1999, pp. 2087-2090.

* cited by examiner

*Primary Examiner*—Abul K. Azad
(74) *Attorney, Agent, or Firm*—Staas & Halsey LLP

(57) ABSTRACT

In a method for grapheme-phoneme conversion of a word which is not contained as a whole in a pronunciation lexicon, the word is firstly decomposed into subwords. The subwords are transcribed and chained. As a result, interfaces are formed between the transcriptions of the subwords. The phonemes at the interfaces must be changed frequently. Consequently, they are subjected to recalculation.

27 Claims, 2 Drawing Sheets

GRAPHEME-PHONEME CONVERSION OF A WORD WHICH IS NOT CONTAINED AS A WHOLE IN A PRONUNCIATION LEXICON

BACKGROUND OF THE INVENTION

1. Field of the Invention

The invention relates to a method, a computer program product, a data medium and a computer system for grapheme-phoneme conversion of a word which is not contained as a whole in a pronunciation lexicon.

2. Description of the Related Art

Speech processing methods in general are known, for example, from U.S. Pat. No. 6,029,135, U.S. Pat. No. 5,732,388, DE 19636739 C1 and DE 19719381 C1. In a speech synthesis system, the script-to-speech conversion or grapheme-phoneme conversion of the words to be spoken is of decisive importance. Errors in sounds, syllable boundaries and word stress are directly audible, can lead to incomprehensibility and can, in the worst case, even distort the sense of a statement.

The best quality speech recognition is obtained when the word to be spoken is contained in a pronunciation lexicon. However, the use of such lexica causes problems. On the one hand, the number of entries increases the search outlay. On the other hand, it is precisely in the case of languages such as German that it is impossible to cover all words in a lexicon, since the possibilities of forming compound words are virtually unlimited.

A morphological decomposition can provide a remedy in this case. A word which is not found in the lexicon is decomposed into its morphological constituents such as prefixes, stems and suffixes and these constituents are searched for in the lexicon. However, a morphological decomposition is problematical precisely in the case of long words, because the number of possible decompositions rises with the word length. However, it requires an excellent knowledge of the word formation grammar of a language. Consequently, words which are not found in a pronunciation lexicon are transcribed with out-of-vocabulary methods (OOV methods), for example, with the aid of neural networks. Such OOV treatments are, however, relatively compute-intensive and generally lead to poorer results than the phonetic conversion of whole words with the aid of a pronunciation lexicon. In order to determine the pronunciation of a word which is not contained in a pronunciation lexicon, the word can also be decomposed into subwords. The subwords can be transcribed with the aid of a pronunciation lexicon or an OOV method. The partial transcriptions found can be appended to one another. However, this leads to errors at the break points between the partial transcriptions.

SUMMARY OF THE INVENTION

It is an object of the invention to improve the joining together of partial transcriptions. This object is achieved by a method, a computer program product, a data medium and a computer system in accordance with the independent claims.

In this case, a computer program product is understood as a computer program as a commercial product in whatever form, for example on paper, on a computer-readable data medium, distributed over a network, etc.

According to the invention, in the grapheme-phoneme conversion of a word which is not contained as a whole in a pronunciation lexicon, the first step is to decompose the word into subwords. A grapheme-phoneme conversion of the subwords is subsequently carried out.

The transcriptions of the subwords are sequenced, at least one interface being produced between the transcriptions of the subwords. Phonemes, bordering on the interface, of the subwords are determined.

It is possible in this case to take account only of the last phoneme of the subword situated upstream of the interface in the temporal sequence of the pronunciation. However, it is better when both this phoneme and the first phoneme of the following syllable are selected for the special treatment according to the invention. Even better results are achieved when further bordering phonemes are included, for example, one or two phonemes upstream of the interface and two downstream of the interface.

Subsequently, those graphemes of the subwords are determined which generate the phonemes bordering on the at least one interface. This can be performed by using a lexicon which specifies which graphemes generated these phonemes. How the lexicon is to be created is set forth in Horst-Udo Hain: "Automation of the Training Procedures for Neural Networks Performing Multilingual Grapheme to Phoneme Conversion", Eurospeech 1999, pages 2087–2090.

Hereafter, the grapheme-phoneme conversion of the specific graphemes is recalculated in the context, that is to say, as a function of the context, of the respective interface. This is possible only because it is clear which phoneme has been created by which grapheme or graphemes.

The interfaces between the partial transcriptions are therefore treated separately. If appropriate, changes to the previously determined partial transcriptions are undertaken. An advantage of the invention which is not inconsiderable for a speech synthesis system is the acceleration of the calculation. Whereas neural networks require approximately 80 minutes for converting the 310 000 words of a typical lexicon for the German language, this is performed in only 25 minutes with the aid of the approach according to the invention.

In an advantageous development of the invention the grapheme-phoneme conversion of the graphemes can be recalculated in the context of the respective interface by using a neural network. A pronunciation lexicon has the advantage of supplying the "correct" transcription. It fails, however, when unknown words occur. Neural networks can, by contrast, supply a transcription for any desired character string, but make substantial errors in this case, in some circumstances. The development of the invention combines the reliability of the lexicon with the flexibility of the neural networks.

The transcription of the subwords can be performed in various ways, for example by using an out-of-vocabulary treatment (OOV treatment). A very reliable way consists in searching for subwords for the word in a database which contains phonetic transcriptions of words. The phonetic transcription recorded in the database for a subword found in the database is then selected as transcription. This leads to useful results for most words or subwords.

If, in addition to the subword found, the word has at least one further constituent which is not recorded in the database, this constituent can be phonetically transcribed by using an OOV treatment. The OOV treatment can be performed by a statistical method, for example by a neural network or in a rule-based fashion, e.g., using an expert system.

The word is advantageously decomposed into subwords of a certain minimum length, so that subwords as large as possible are found and correspondingly few corrections arise.

The invention is explained in more detail below with the aid of exemplary embodiments which are illustrated schematically in the figures.

DETAILED DESCRIPTION OF THE PREFERRED EMBODIMENTS

Figure 1:
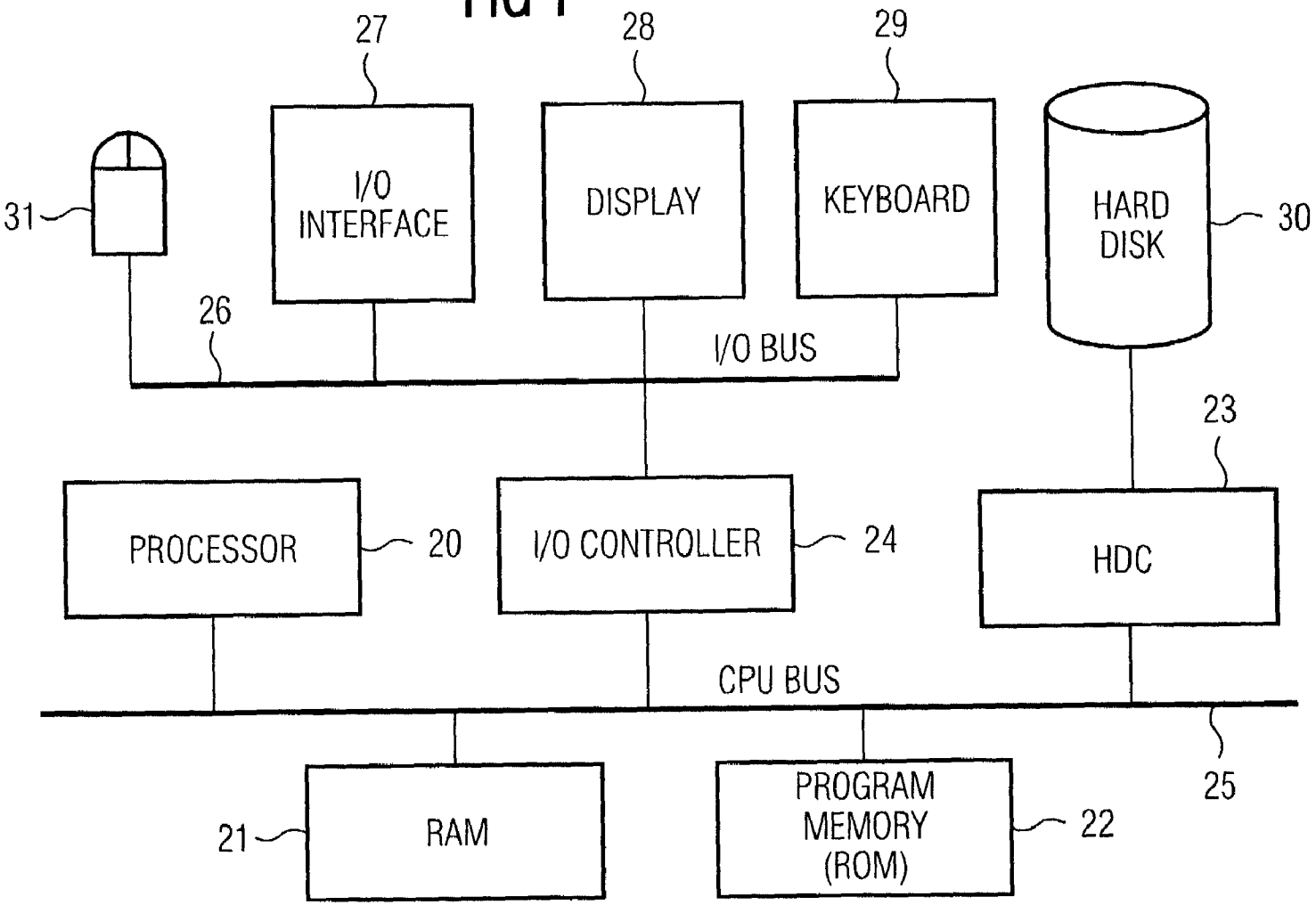
FIG. 1 shows a computer system suitable for grapheme-phoneme conversion.
Figure 2:
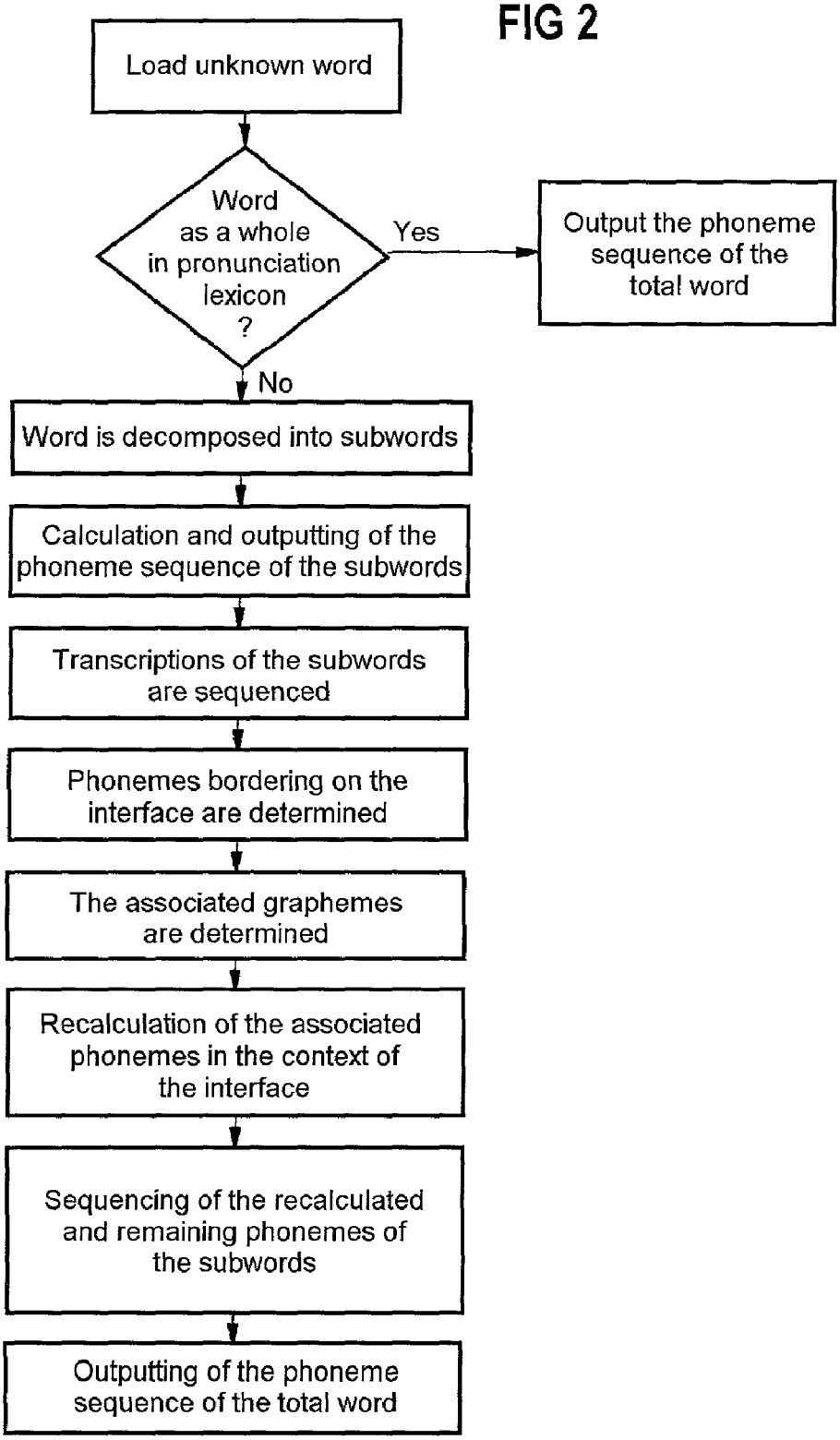
FIG. 2 shows a schematic of the method according to the invention.

FIG. 1 shows a computer system suitable for grapheme-phoneme conversion of a word. The system has a processor (CPU)20, a main memory (RAM)21, a program memory (ROM)22, a hard disk controller (HDC)23, which controls a hard disk 30 and an interface (I/O) controller 24. The processor 20, main memory 21, program memory 22, hard disk controller 23 and interface controller 24 are coupled to one another via a bus, the CPU bus 25, for the purpose of exchanging data and instructions. Furthermore, the computer has an input/output (I/O) bus 26 which couples the various input and output devices to the interface controller 24. The input and output devices include, for example, a general input and output (I/O) interface 27, a display 28, a keyboard 29 and a mouse 31.

Taking the German word "uberflüssigerweise" as an example for grapheme-phoneme conversion, the first step is to attempt to decompose the word into subwords which are constituents of a pronunciation lexicon. A minimum length is prescribed for the constituents being sought in order to restrict the number of possible decompositions to a sensible measure. Six letters have proved to be sensible in practice as minimum length for the German language.

All the constituents found are stored in a chained list. In the event of a plurality of possibilities, use is always made of the longest constituent or the path with the longest constituents.

If not all parts of the word are found as subwords in the pronunciation lexicon, the remaining gaps in the preferred exemplary embodiment are closed by a neural network. By contrast with the standard application of the neural network, in case of which the transcription must be created for the entire word, the task in filling up the gaps is simpler because at least the left-hand phoneme context can be assumed as certain since it does originate, after all, from the pronunciation lexicon. The input of the preceding phonemes therefore stabilizes the output of the neural network for the gap to be filled, since the phoneme to be generated depends not only on the letters, but also on the preceding phoneme.

A problem in mutually appending the transcriptions from the lexicon and in determining the transcription for the gaps by a neural network consists in that in some cases the last sound of the preceding, left-hand transcription has to be changed. This is the case with the considered word "überflüssigerweise". It is not found in the lexicon as a whole, but the subword "überflüssig" and the subword "erweise" are.

For the purpose of better distinction, graphemes are enclosed below in pointed brackets <>, and phonemes in square brackets [].

The ending <-ig> at the end of a syllable is spoken as [IC], represented in the SAMPA phonetic transcription, that is to say as [I] (lenis short unrounded front vowel) followed by the "Ich" sound [C] (voiceless palatal fricative). The prefix <er-> is spoken as [Er], with an [E] (lenis short unrounded half-open front vowel, open "e") and an [r] (central sonorant).

In the case of simple chaining of the transcriptions, it is sensible to insert automatically between the two words a syllable boundary represented by a hyphen "-". The result as overall transcription of the word <über-flüssigerweise> is therefore:

[y:-b6-flY-slC-Er-val-z@]

instead of, correctly,

[y:-b6-flY-sl-g6-val-z@]

with a [g] (voiced velar plosiv) and a [6] (unstressed central half-open vowel with velar coloration) as well as a displaced syllable boundary. This would mean that sound and syllable boundary were wrong at the word boundary.

A remedy may be provided here by using a neural network to calculate the last sound of the left-hand transcription. In this case, however, the question arises as to which letters at the end of the left-hand transcription are to be used to determine the last sound.

A special pronunciation lexicon is used for this decision. The special feature of this lexicon consists in that it contains the information as to which grapheme group belongs to which sound. How the lexicon is to be created is set forth in Horst-Udo Hain: "Automation of the Training Procedures for Neural Networks Performing Multilingual Grapheme to Phoneme Conversion", Eurospeech 1999, pages 2087–2090.

The entry for "überflüssig" has the following form in this lexicon:

| | | | | | | | | | | | |
|---|---|---|---|---|---|---|---|---|---|---|---|
| ü | — | b | er | — | f | l | ü | — | ss | i | g |
| y: | — | b | 6 | — | f | l | y | — | s | I | C |

It is therefore possible to determine uniquely from which grapheme group the last sound has arisen, specifically from the <g>.

The neural network can now use the right-hand context <erweise> now present to make a new decision on the phoneme and syllable boundary at the end of the word. The result in this case is the phoneme [g], in front of which a syllable boundary is set.

The syllable boundary is now at the correct position and the <g > is also transcribed as [g] and not as [C].

The first sound of the right-hand transcription is redetermined using the same scheme. The correct transcription for <er-> of <erweise> is at this point [6] and not [Er]. Here, two sounds precisely are to be checked, for which reason two sounds are always checked in the preferred exemplary embodiment.

The correct phonetic transcription at this interface is obtained as a result.

Further improvements are to be achieved when use is made for the purpose of filling up the transcription gaps, not of the standard network, which has been trained to convert whole words, but of a network specifically trained to fill up the gaps. At least in the cases in which the right-hand phoneme context is also present, a specific network is on offer which uses the right-hand phoneme context to decide on the sound to be generated.

What is claimed is:

1. A method for grapheme-phoneme conversion of a word which is not contained as a whole in a pronunciation lexicon, comprising:

decomposing the word into subwords;

performing grapheme-phoneme conversion of the subwords to obtain transcriptions of the subwords;

sequencing the transcriptions of the subwords are sequenced to produce at least one interface between the transcriptions of the subwords, determining phonemes of the subwords bordering on the at least one interface;

determining graphemes of the subwords which generate the phonemes bordering on the at least one interface; and recalculating grapheme-phoneme conversion of the graphemes bordering on the at least one interface between the subwords as a function of the context of the at least one interface.

2. The method as claimed in claim 1, wherein said recalculating is performed by a neural network.

3. The method as claimed in claim 1, wherein said recalculating is performed using a lexicon.

4. The method as claimed in claim 1, wherein said decomposing includes searching for the subwords of the word in a database containing phonetic transcriptions of words, and wherein said performing includes selecting a phonetic transcription recorded in the database for each subword found in the database.

5. The method as claimed in claim 4, wherein in addition to the subword, the word has at least one further constituent which is not recorded in the database, and wherein said method further comprises phonetically transcribing the at least one further constituent by an out-of-vocabulary method.

6. The method as claimed in claim 5, wherein the out-of-vocabulary method is performed by one of a neural network and an expert system.

7. The method as claimed in claim 1, wherein the word is decomposed into subwords of a predefined minimum length.

8. At least one computer-readable medium storing at least one computer program to perform a method for grapheme-phoneme conversion of a word which is not contained as a whole in a pronunciation lexicon, said method comprising:

decomposing the word into subwords;

performing grapheme-phoneme conversion of the subwords to obtain transcriptions of the subwords;

sequencing the transcriptions of the subwords are sequenced to produce at least one interface between the transcriptions of the subwords, determining phonemes of the subwords bordering on the at least one interface;

determining graphemes of the subwords which generate the phonemes bordering on the at least one interface; and recalculating grapheme-phoneme conversion of the graphemes bordering on the at least one interface between the subwords as a function of the context of the at least one interface.

9. The at least one computer-readable medium as claimed in claim 8, wherein said recalculating is performed by one of a neural network and an expert system.

10. The at least one computer-readable medium as claimed in claim 8, wherein said recalculating is performed using a lexicon.

11. The at least one computer-readable medium as claimed in claim 8, wherein said decomposing includes searching for the subwords of the word in a database containing phonetic transcriptions of words, and wherein said performing includes selecting a phonetic transcription recorded in the database for each subword found in the database.

12. The at least one computer-readable medium as claimed in claim 11, wherein in addition to the subword, the word has at least one further constituent which is not recorded in the database, and wherein said method further comprises phonetically transcribing the at least one further constituent by an out-of-vocabulary method.

13. The at least one computer-readable medium as claimed in claim 12, wherein the out-of-vocabulary method is performed by a neural network.

14. The at least one computer-readable medium as claimed in claim 8, wherein the word is decomposed into subwords of a predefined minimum length.

15. A computer system for storing at least one computer program to perform a method for grapheme-phoneme conversion of a word which is not contained as a whole in a pronunciation lexicon, comprising:

means for decomposing the word into subwords;

means for performing grapheme-phoneme conversion of the subwords to obtain transcriptions of the subwords;

means for sequencing the transcriptions of the subwords are sequenced to produce at least one interface between the transcriptions of the subwords, means for determining phonemes of the subwords bordering on the at least one interface;

means for determining graphemes of the subwords which generate the phonemes bordering on the at least one interface; and means for recalculating grapheme-phoneme conversion of the graphemes bordering on the at least one interface between the subwords as a function of the context of the at least one interface.

16. The computer system as claimed in claim 15, wherein said recalculating means includes a neural network.

17. The computer system as claimed in claim 15, wherein said recalculating means uses a lexicon.

18. The computer system as claimed in claim 15, wherein said decomposing means includes a database containing phonetic transcriptions of words and searches for the subwords of the word in the database, and wherein said performing includes means for selecting a phonetic transcription recorded in the database for each subword found in the database.

19. The computer system as claimed in claim 18, wherein in addition to the subword, the word has at least one further constituent which is not recorded in the database, and wherein said computer system further comprises transcribing means for phonetically transcribing the at least one further constituent by an out-of-vocabulary method.

20. The computer system as claimed in claim 19, wherein said transcribing means includes one of a neural network and an expert system to perform the out-of-vocabulary method.

21. The computer system as claimed in claim 15, wherein said decomposing means decomposes the word into subwords of a predefined minimum length.

22. A computer system for grapheme-phoneme conversion of a word which is not contained as a whole in a pronunciation lexicon, comprising:

at least one storage device to store a computer program on a storage medium; and a processing unit, coupled to the at least one storage device, to load and execute the computer program to decompose the word into subwords, perform grapheme-phoneme conversion of the subwords to obtain transcriptions of the subwords; sequence the transcriptions of the subwords to produce at least one interface between the transcriptions of the subwords, determine phonemes of the subwords bordering on the at least one interface, determine graphemes of the subwords which generate the phonemes bordering on the at least one interface, recalculate the grapheme-phoneme conversion of the graphemes bordering on the at least one interface between the subwords as a function of the context of the at least one interface, and write the phonemes at the at least one interface into the at least one storage device after recalculation.

23. The computer system as claimed in claim 22, wherein said recalculating is performed by a neural network.

24. The computer system as claimed in claim 22, wherein said recalculating is performed using a lexicon.

25. The computer system as claimed in claim 22, wherein said decomposing includes searching for the subwords of the word in a database containing phonetic transcriptions of words, and wherein said performing includes selecting a phonetic transcription recorded in the database for each subword found in the database.

26. The computer system as claimed in claim 25, wherein in addition to the subword, the word has at least one further constituent which is not recorded in the database, and wherein said process unit further phonetically transcribes the at least one further constituent by an out-of-vocabulary method.

27. The computer system as claimed in claim 22, wherein the word is decomposed into subwords of a predefined minimum length.

* * * * *